US008170238B2

(12) United States Patent
Wu

(10) Patent No.: US 8,170,238 B2
(45) Date of Patent: May 1, 2012

(54) INTEGRATED CIRCUIT ATTACHED TO MICROPHONE

(75) Inventor: Li-Te Wu, Taipei (TW)

(73) Assignee: Fortemedia, Inc., Sunnyvale, CA (US)

( * ) Notice: Subject to any disclaimer, the term of this patent is extended or adjusted under 35 U.S.C. 154(b) by 768 days.

(21) Appl. No.: 12/326,207

(22) Filed: Dec. 2, 2008

(65) Prior Publication Data

US 2010/0135508 A1 Jun. 3, 2010

(51) Int. Cl.
*H04R 3/00* (2006.01)

(52) U.S. Cl. ..... 381/113; 381/122; 381/191

(58) Field of Classification Search ..... 381/122, 381/113, 191
See application file for complete search history.

(56) References Cited

U.S. PATENT DOCUMENTS 4,631,749 A * 12/1986 Rapaich ..... 381/103
2003/0098805 A1 * 5/2003 Bizjak ..... 341/139

* cited by examiner

*Primary Examiner* — Steven J Fulk
(74) *Attorney, Agent, or Firm* — Thomas|Kayden

(57) ABSTRACT

The invention provides an integrated circuit attached to a microphone. In one embodiment, the integrated circuit comprises a buffer, a gain stage, an analog-to-digital converter (ADC), and a memory module. The buffer buffers a first signal generated by the microphone, and outputs the first signal as a second signal. The gain stage amplifies the second signal according to an adjustable gain to obtain a third signal. The analog-to-digital converter converts the third signal from analog to digital to obtain a fourth signal as an output of the integrated circuit. The memory module stores the adjustable gain and outputs the adjustable gain to the gain stage for controlling amplification of the gain stage.

16 Claims, 7 Drawing Sheets

INTEGRATED CIRCUIT ATTACHED TO MICROPHONE

BACKGROUND OF THE INVENTION

1. Field of the Invention

The invention relates to microphones, and more particularly to gain calibration for microphones.

2. Description of the Related Art

A microphone converts a sound into an electric signal. The electric signal generated by the microphone, however, has a small amplitude and requires to be amplified for further processing. A conventional microphone module therefore comprises a microphone and an amplification circuit for amplifying the electric signal generated by the microphone.

A conventional amplification circuit is a junction field effect transistor (JFET). Referring to FIG. 1, a block diagram of a conventional microphone module 100 is shown. The conventional microphone module 100 comprises a microphone 102, a JFET 104, and a load resistor 106. The microphone 102 is modeled as a voltage source 112 coupled between a ground and an output capacitor 114. The voltage source 112 has an amplitude $V_M$ proportional to a received sound pressure $P_M$. A sensitivity of the microphone 102 is then determined as $$S_M = \frac{\partial V_M}{\partial P_M}.$$

When the microphone 102 is an electret condenser microphone (ECM), the sensitivity of the ECM is roughly −40 dBV/Pa.

The JFET 104 is biased as a common source configuration and is coupled between an output node 110 and a ground. The electric voltage output by the microphone 102 is applied to a gate of the JFET 104. The load resistor 106 is coupled between a voltage source and the output node 110. The JFET 104 can be modeled as an input capacitor 122, two diodes 124 and 126, and a PMOS 128. Therefore, an output voltage generated by the JFET 104 at the output node is according to the following algorithm:

$$V_O = S_M \cdot \frac{C_O}{C_I + C_O} \cdot G_m \cdot R_L,$$

wherein $V_O$ is the output voltage, $S_M$ is a sensitivity of the microphone 102, $C_O$ is capacitance of the output capacitor 114, $C_I$ is capacitance of the input capacitor 122, $G_m$ is a transconductance of the NMOS transistor 128, and $R_L$ is resistance of the load resistor 106.

The output voltage of the microphone module 100 at the output node 110 is therefore attenuated with increase of the capacitance of the output capacitor 114. For example, when the capacitance $C_O$ of the output capacitor 114 is 5 pF and the capacitance $C_I$ of the input capacitor 122 is 1 pF, the output voltage at the output node 110 is attenuated by 1.58 dB. When the microphone 102 is a micro-electronic-mechanical-system (MEMS) microphone, the output capacitor 114 has smaller capacitance of about 1 pF, and the output signal at the output node 110 is further attenuated; thus, degrading performance of the microphone module 100. Thus, an amplification circuit with an adjustable gain for amplifying an output signal of a microphone is required to avoid attenuation due to parasitic capacitance of the microphone.

BRIEF SUMMARY OF THE INVENTION

The invention provides an integrated circuit attached to a microphone. In one embodiment, the integrated circuit comprises a buffer, a gain stage, an analog-to-digital converter (ADC), and a memory module. The buffer buffers a first signal generated by the microphone, and outputs the first signal as a second signal. The gain stage amplifies the second signal according to an adjustable gain to obtain a third signal. The analog-to-digital converter converts the third signal from analog to digital to obtain a fourth signal as an output of the integrated circuit. The memory module stores the adjustable gain and outputs the adjustable gain to the gain stage for controlling amplification of the gain stage.

The invention also provides a method for gain calibration for a microphone module. In one embodiment, the microphone module generates an output signal according to an adjustable gain. First, the adjustable gain of the microphone module is set to a default gain. A monotone sound is then played in front of the microphone module. After the microphone module converts the monotone sound according to the default gain to the output signal, a new gain is determined according to the output signal. Finally, the adjustable gain of the microphone module is set to the new gain The invention provides a microphone gain calibration system. In one embodiment, the microphone gain calibration system comprises a speaker, a microphone module, and a computer. The speaker plays a monotone sound. The microphone module comprises a microphone converting the monotone sound into a first signal, and an integrated circuit amplifying the first signal according to a default gain to generate an output signal. The computer determines a target sensitivity, measures an actual sensitivity of the microphone module according to the output signal, determines the new gain according to the default gain and a difference between the target sensitivity and the actual sensitivity, and changes an adjustable gain of the integrated circuit from the default gain to the new gain.

The invention also provides an integrated circuit attached to a microphone. In one embodiment, the integrated circuit comprises a buffer, a filter, an analog-to-digital converter (ADC), and a memory module. The buffer buffers a first signal generated by the microphone, and outputs the first signal as a second signal. The filter amplifies the second signal according to a frequency response to obtain a third signal. The analog-to-digital converter converts the third signal from analog to digital to obtain a fourth signal as an output of the integrated circuit. The memory module stores the frequency response and outputs the frequency response to the filter for controlling filtration of the filter.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
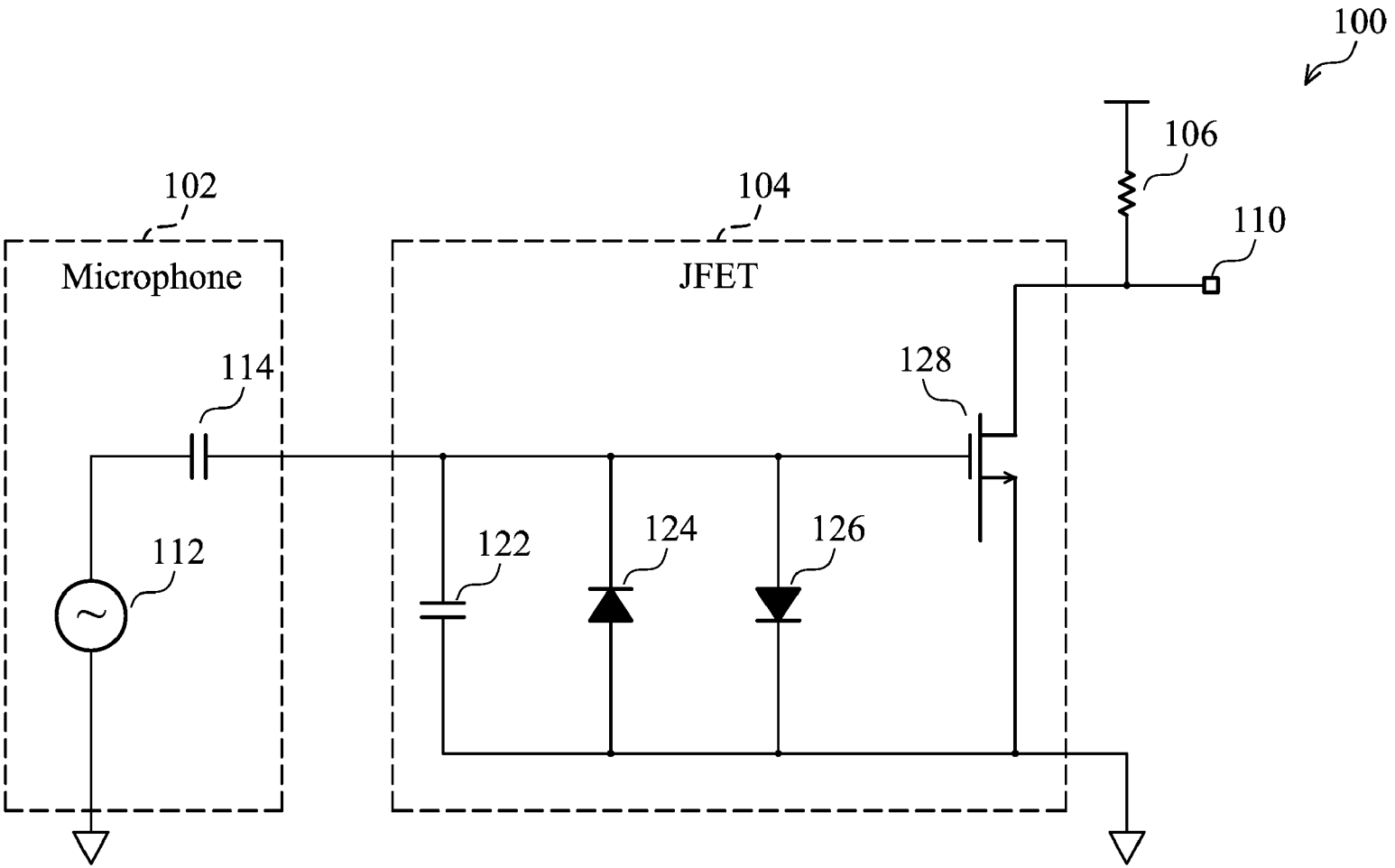
FIG. 1 ( PRIOR ART )
FIG. 1 is a block diagram of a conventional microphone module.
Figure 2:
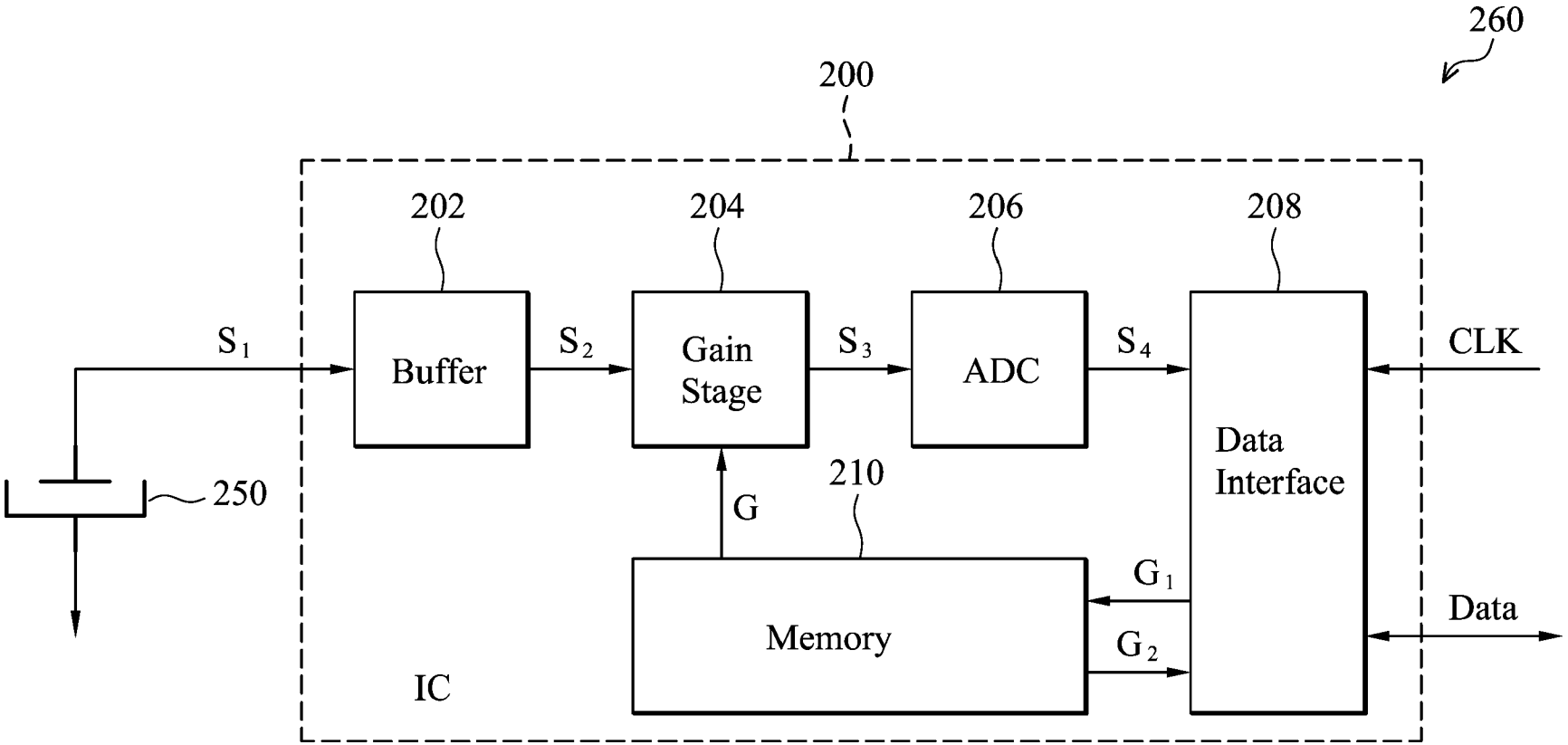
FIG. 2 is a block diagram of a microphone module according to the invention.

Referring to FIG. 2, a block diagram of a microphone module 260 according to the invention is shown. The microphone module 260 comprises a microphone 250 and an integrated circuit (IC) 200. The microphone 250 converts a sound into an electric signal $S_1$, and the integrated circuit 200 then amplifies the electric signal $S_1$. In one embodiment, the integrated circuit 200 comprises a buffer 202, a gain stage 204, an analog-to-digital converter 206, a data interface 208, and a memory module 210. The buffer 202 buffers the signal $S_1$ generated by the microphone 250, and outputs the signal $S_1$ as a signal $S_2$. The gain stage 204 amplifies the signal $S_2$ according to an adjustable gain to obtain a signal $S_3$. The analog-to-digital converter 206 converts the signal $S_3$ from analog to digital to obtain a signal $S_4$ as an output of the integrated circuit 200. The memory module 210 stores the adjustable gain G, and outputs the adjustable gain G to the gain stage 204 for controlling amplification of the gain stage 204.

The data interface 208 couples the integrated circuit 200 to a computer. The computer provides the integrated circuit 200 with a clock signal CLK for operating the integrated circuit 200, and the data interface 208 receives the clock signal CLK from the computer. In addition, the data interface 208 outputs the signal $S_4$ to the computer, and sets the adjustable gain G stored in the memory module 210 according to instructions of the computer. In one embodiment, the data interface 208 is coupled to the computer via a bi-directional data path. When the clock signal CLK is at a normal frequency, the data path is an output path, and the data interface 208 outputs the signal $S_4$ to the computer via the data path. When the clock signal CLK is at a lower frequency, the data path is an input path, and the data interface 208 inputs the adjustable gain $G_1$ from the computer via the data path and writes the adjustable gain $G_1$ to the memory module 210. The data interface 208 can further retrieve a current gain $G_2$ from the memory module 210 and deliver the current gain $G_2$ to the computer.

Figure 3:
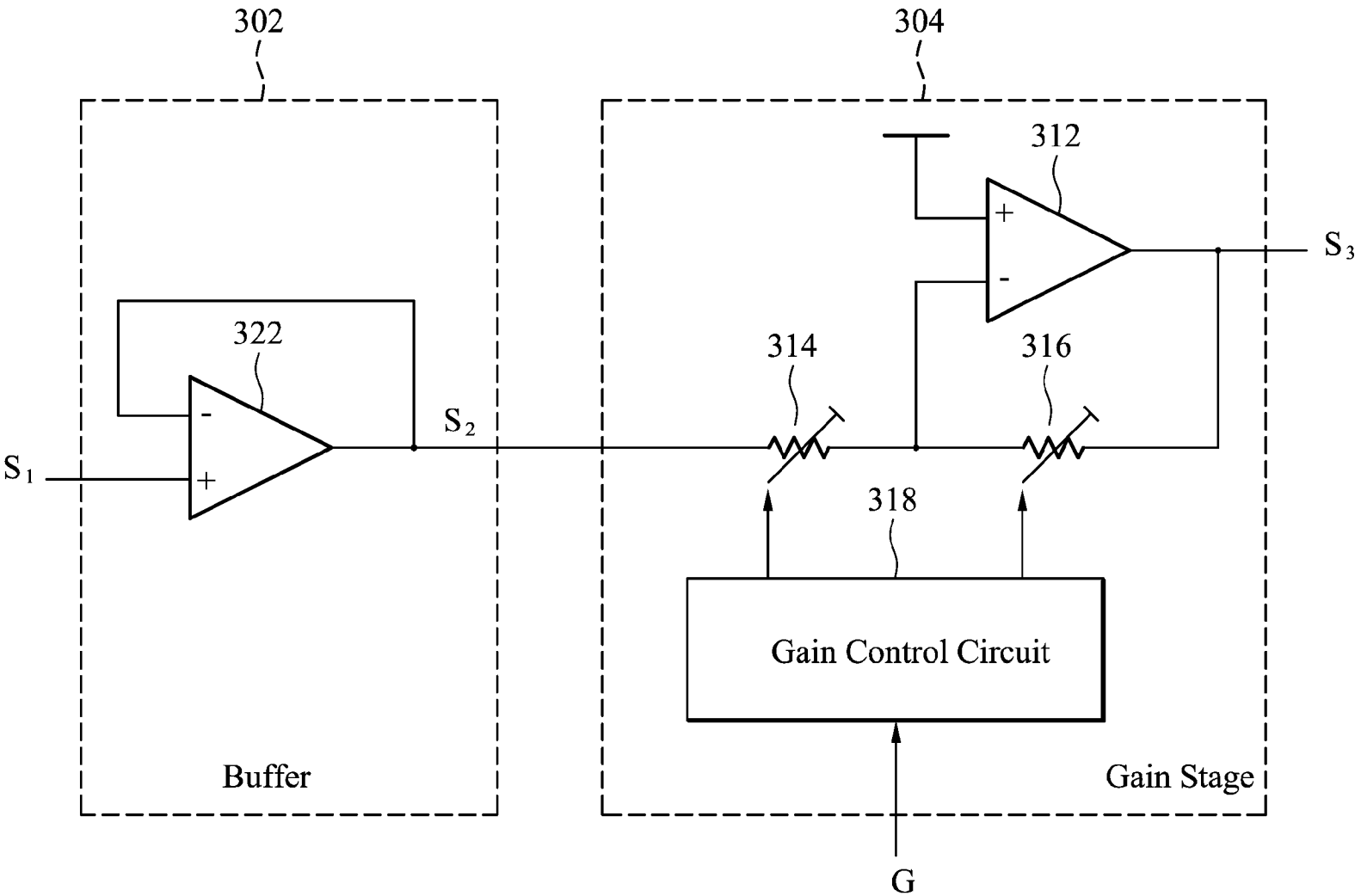
FIG. 3 is a block diagram of an embodiment of a buffer and a gain stage according to the invention.

Referring to FIG. 3, a block diagram of an embodiment of a buffer 302 and a gain stage 304 according to the invention is shown. The buffer 302 comprises an operational amplifier 322. The signal $S_1$ generated by a microphone is applied to a positive input terminal of the operational amplifier 322. A negative input terminal of the operational amplifier 322 is coupled to an output terminal of the operational amplifier 322. Thus, the operation amplifier 322 forms a unity gain buffer which outputs the signal $S_2$ with the same amplitude as the signal $S_1$. The gain stage 304 comprises an operational amplifier 312, two adjustable resistors 314 and 316, and a gain control circuit 318. The adjustable resistor 314 is coupled between the output terminal of the operational amplifier 322 and a negative input terminal of the operational amplifier 312. The adjustable resistor 316 is coupled between the negative input terminal and an output terminal of the operational amplifier 312. A positive input terminal of the operational amplifier 312 is coupled to a voltage source. The gain control circuit 318 adjusts resistance of the adjustable resistor 314 and 316 according to the adjustable gain G. Because a gain of the gain stage 304 is equal to a ratio of the resistance of the adjustable resistor 316 to the resistance of the adjustable resistor 314, the gain control circuit 318 can adjust resistance of the adjustable resistor 314 and 316 to make the gain of the gain stage 304 equal to the gain value G assigned by the memory module 210, thus generating a signal $S_3$ amplified according to the gain value G at the output node of the operational amplifier 312.

Figure 4:
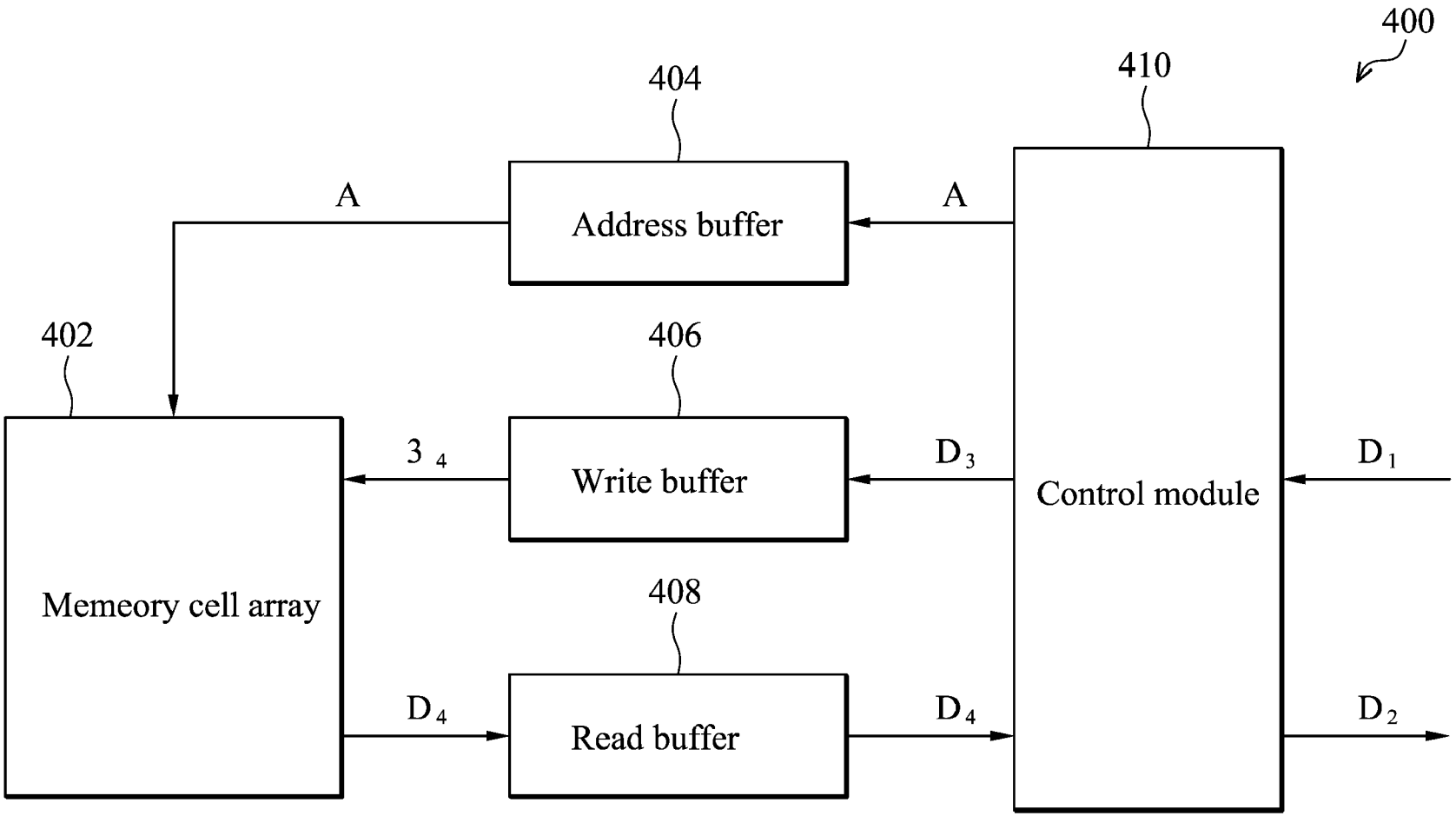
FIG. 4 is a block diagram of a memory module according to the invention.

Referring to FIG. 4, a block diagram of a memory module 400 according to the invention is shown. The memory module 400 is an embodiment of the memory module 210 of FIG. 2. In one embodiment, the memory module 400 comprises a memory cell array 402, an address buffer 404, a write buffer 406, a read buffer 408, and a control module 410. The memory cell array 402 stores the adjustable gain delivered to the gain stage 204. The control module 410 is an interface between the data interface 208 and the memory cell array 402. When a computer wants to adjust the adjustable gain G stored in the memory module 400, the data interface 208 sends a request for accessing the memory cell array 402 to the control module 410. The control module 410 then controls the address buffer 404, the write buffer 406, and the read buffer 408 to access the adjustable gain stored in the memory cell array 402.

The control module 410 first stores a target address of the adjustable gain G in the address buffer 404, and then stores a new value of the adjustable gain G in the write buffer 406. The memory cell array 402 then sets the adjustable gain G to the new value stored in the write buffer 406 according to the address stored in the address buffer 404. The control module 410 can also reads the adjustable gain stored in the memory cell array 402 to the read buffer 408 according to the address stored in the address buffer 404 and delivers the read adjustable gain value to the computer through the data interface 208. In addition to the adjustable gain value, the control module 410 can also store other information to the memory cell array 402 according to instruction of the computer as a reference of failure analysis, such as a batch number of the microphone module 260.

Figure 5:
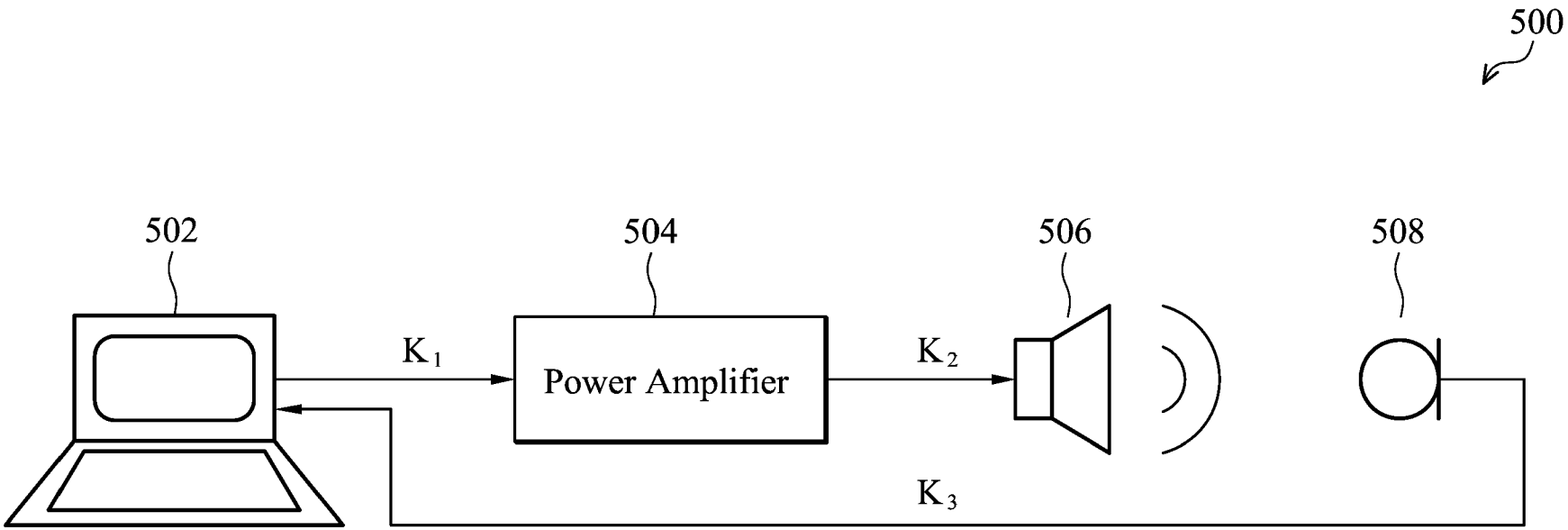
FIG. 5 is a block diagram of a microphone gain calibration system according to the invention.
Figure 6:
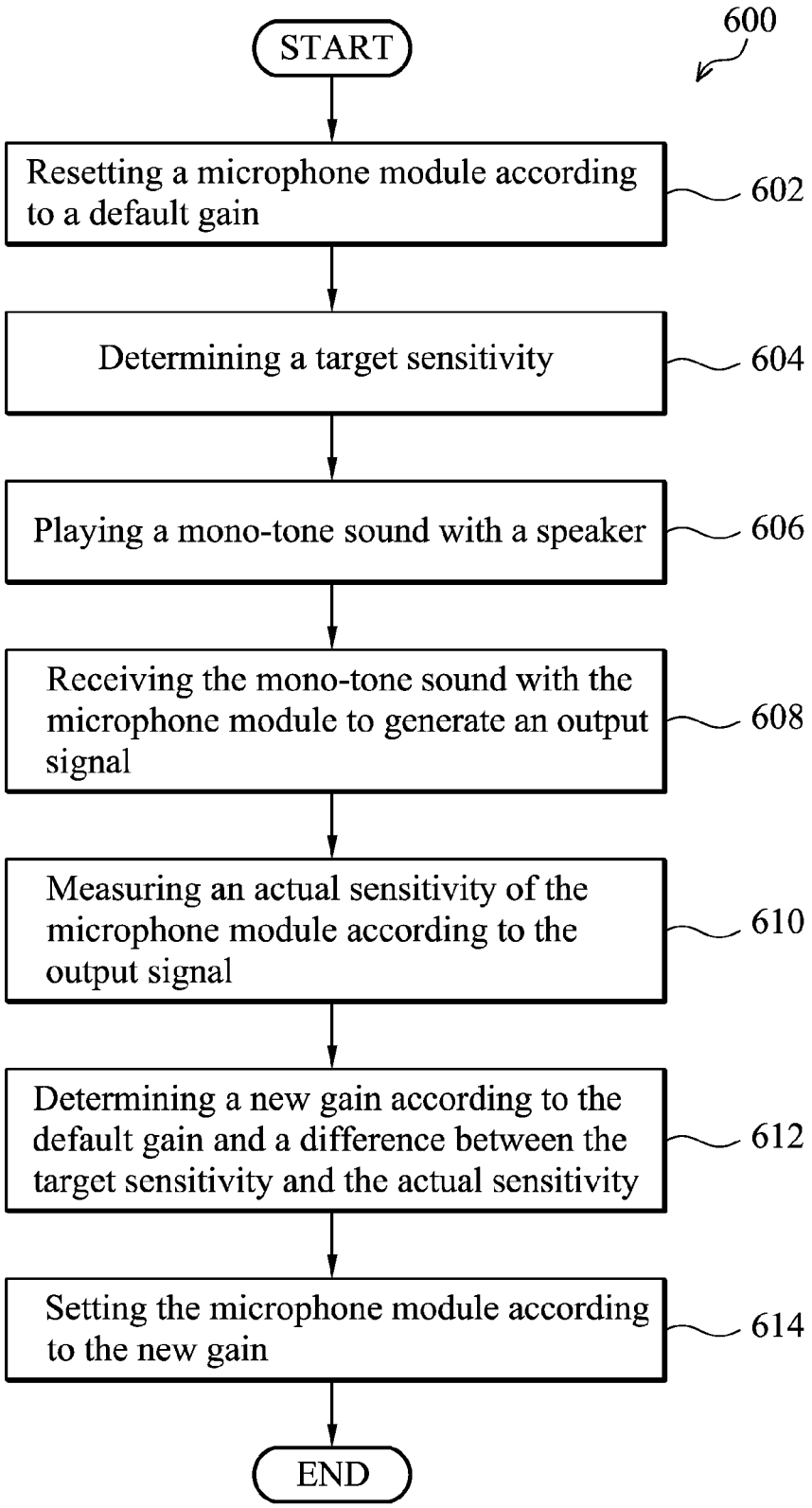
FIG. 6 is a flowchart of a method for gain calibration for a microphone module according to the invention.

To calibrate an adjustable gain value G of the gain stage 204 of a microphone module 260, a computer must perform a gain calibration procedure. Referring to FIG. 5, a block diagram of a microphone gain calibration system 500 according to the invention is shown. The microphone gain calibration system 500 comprises a computer 502, a power amplifier 504, a speaker 506, and a microphone module 508. The speaker 506 is placed in front of the microphone module 508. The computer 502 is coupled to the speaker 506 via a power amplifier 504. In addition, the computer 502 is also coupled to the microphone module 508. Referring to FIG. 6, a flowchart of a method 600 for gain calibration for the microphone module 508 according to the invention is shown. The computer 502 first resets the microphone module 508 to a default gain $G_0$ (step 602). The computer 502 then determines a target sensitivity $S_T$ of the microphone module 508 (step 604). The computer 502 then plays a mono-tone sound with the speaker 506 (step 606). In one embodiment, the computer 502 generates a monotone signal $K_1$, and the power amplifier 504 amplifies the monotone signal $K_1$ to obtain an amplified signal $K_2$, and the speaker 506 broadcasts the amplified signal $K_2$ to obtain a monotone sound.

The microphone module 508 then converts the mono-tone sound to an output signal $K_3$, wherein the output signal $K_3$ is amplified according to the default gain $G_0$ by the microphone module 508 before it is output to the computer 502 (step 608). The computer 502 then measures an actual sensitivity $S_M$ of the microphone module 508 according to the output signal $K_3$ (step 610). The computer 502 then determines a new gain $G_{NEW}$ according to the default gain $G_0$ and a difference between the target sensitivity $S_T$ and the actual sensitivity $S_M$ (step 612). In one embodiment, the computer 502 determines the new gain according to the following algorithm:

$$G_{NEW}=G_0+(S_T-S_M),$$

wherein $G_{NEW}$ is the new gain, $G_0$ is the default gain, $S_T$ is the target sensitivity, and $S_M$ is the actual sensitivity. Finally, the computer 502 sets the adjustable gain of the gain stage 204 of the microphone module 508 to the new gain $G_{NEW}$ (step 614). After the adjustable gain value of the gain stage 204 is set to the new gain value $G_{NEW}$, the sensitivity of the microphone module 508 is adjusted to the target sensitivity $S_T$. Thus, even if original sensitivities of the microphone modules are different, the sensitivities of all microphone modules can be calibrated to the same target sensitivity $S_T$.

Figure 7:
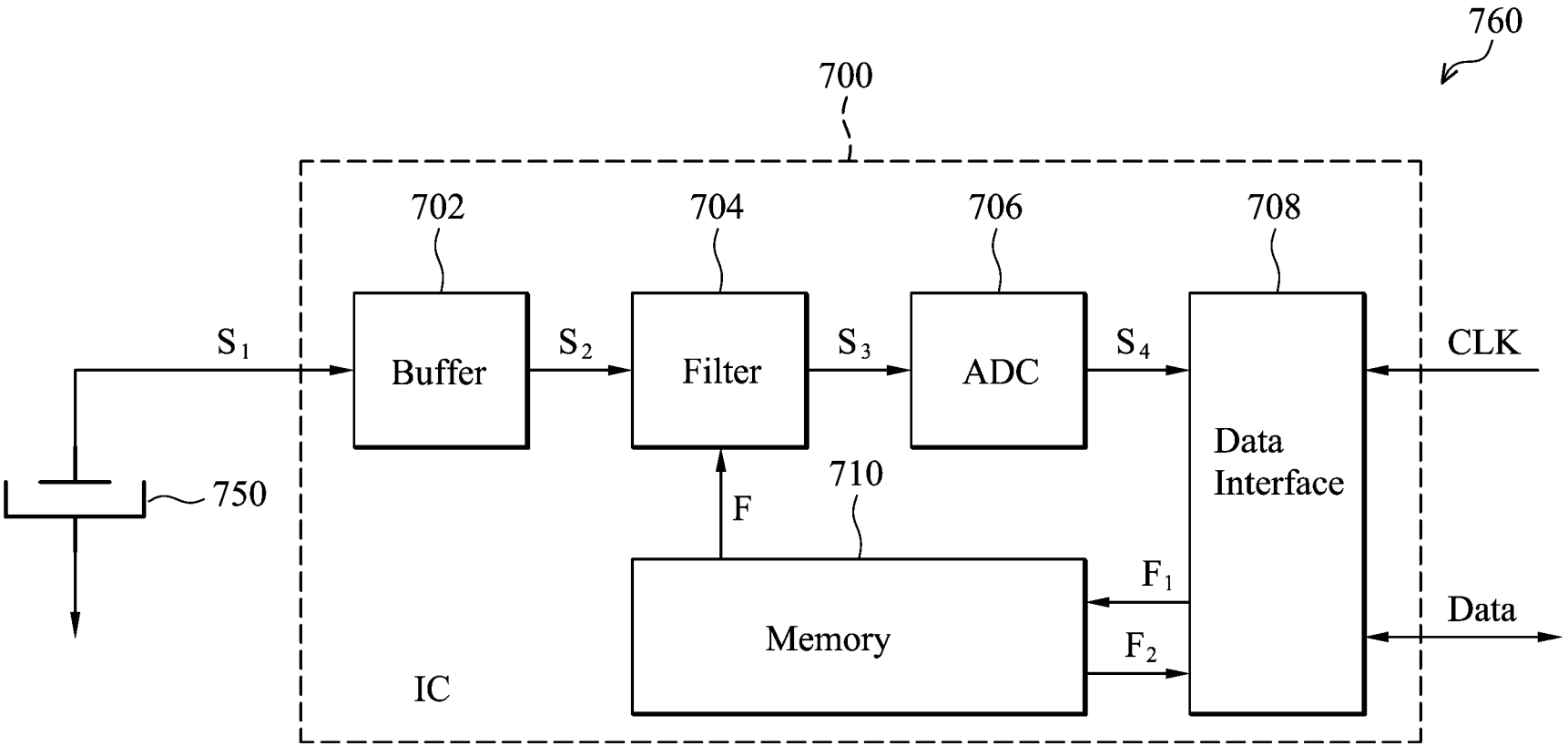
FIG. 7 is a block diagram of another embodiment of a microphone module according to the invention.

Referring to FIG. 7, a block diagram of another embodiment of a microphone module 760 according to the invention is shown. The microphone module 760 comprises a microphone 750 and an integrated circuit 700. The integrated circuit 700 is roughly similar to the integrated circuit 200 shown in FIG. 2 except for the memory module 710 and the filter 704. The data interface 708 stores a frequency response $F_1$ to the memory module 710 according to instructions of a computer. The memory module 710 can have a structure similar to that shown in FIG. 4 and provides the filter 704 with a frequency response F. The filter 704 filters a signal $S_2$ generated by the microphone 750 according to the frequency response F to obtain a filtered signal $S_3$. In one embodiment, the filter 704 may be a low pass filter, a high pass filter, a band pass filter, or a phase shift filter. The analog-to-digital converter 706 then converts the signal $S_3$ from analog to digital to obtain the signal $S_4$ as an output of the microphone module 760.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An integrated circuit attached to a microphone, comprising:

a buffer, buffering a first signal generated by the microphone, and outputting the first signal as a second signal;

a gain stage, amplifying the second signal according to an adjustable gain to obtain a third signal;

an analog-to-digital converter (ADC), converting the third signal from analog to digital to obtain a fourth signal as an output of the integrated circuit; and a memory module, storing the adjustable gain, and outputting the adjustable gain to the gain stage for controlling amplification of the gain stage;

wherein the gain stage comprises:

a second operational amplifier, having a positive input terminal coupled to a voltage source and an output terminal generating the third signal;

a first adjustable resistor, coupled between an output terminal of the buffer and a negative input terminal of the second operational amplifier, wherein the output terminal of the buffer generates the second signal;

a second adjustable resistor, coupled between the negative input terminal and the output terminal of the second operational amplifier; and a gain control circuit, adjusting resistance of the first adjustable resistor and the second adjustable resistor according to the adjustable gain.

2. The integrated circuit as claimed in claim 1, wherein the buffer comprises a first operational amplifier, having a positive input terminal receiving the first signal, an output terminal outputting the second signal, and a negative input terminal coupled to the output terminal.

3. The integrated circuit as claimed in claim 1, wherein the memory module comprises:

an address buffer, storing a target address;

a memory cell array, storing the adjustable gain;

a write buffer, buffering the adjustable gain written to the target address of the memory cell array;

a read buffer, buffering the adjustable gain read from the target address of the memory cell array;

a control module, controlling the address buffer, the write buffer, and the read buffer to access the adjustable gain stored in the memory cell array.

4. The integrated circuit as claimed in claim 1, wherein the integrated circuit further comprises a data interface, coupled to a computer, receiving a clock signal for operating the integrated circuit from the computer, outputting the fourth signal to the computer, and setting the adjustable gain stored in the memory module according to the computer.

5. The integrated circuit as claimed in claim 4, wherein the data interface is coupled to the computer via a data path, and the data interface outputs the fourth signal to the computer via the data path when the clock signal is at a normal frequency, and the data interface inputs the adjustable gain from the computer via the data path when the clock signal is at a lower frequency.

6. The integrated circuit as claimed in claim 4, wherein when a gain calibration procedure is performed, the computer sets the adjustable gain of the integrated circuit to a default gain and plays a monotone sound in front of the microphone, the microphone converts the monotone sound to the first signal, the integrated circuit generates the fourth signal according to the first signal and the default gain, and the computer then determines a new gain according to the fourth signal and sets the adjustable gain of the integrated circuit to the new gain.

7. The integrated circuit as claimed in claim 6, wherein the computer determines a target sensitivity, measures an actual sensitivity of the integrated circuit according to the fourth signal, and determines the new gain according to the default gain and a difference between the target sensitivity and the actual sensitivity.

8. The integrated circuit as claimed in claim 7, wherein the computer determines the new gain according to the following algorithm:

$$G_{NEW}=G_0+(S_T-S_M);$$

wherein $G_{NEW}$ is the new gain, $G_0$ is the default gain, $S_T$ is the target sensitivity, and $S_M$ is the actual sensitivity.

9. The integrated circuit as claimed in claim 1, wherein the microphone is an electret condenser microphone (ECM).

10. A method for gain calibration for a microphone module, wherein the microphone module generates an output signal according to an adjustable gain, comprising:

setting the adjustable gain of the microphone module to a default gain;

playing a monotone sound in front of the microphone module;

after the microphone module converts the monotone sound according to the default gain to the output signal, determining a new gain according to the output signal; and setting the adjustable gain of the microphone module to the new gain;

wherein determination of the new gain comprises:

determining a target sensitivity;

measuring an actual sensitivity of the microphone module according to the output signal; and determining the new gain according to the default gain and a difference between the target sensitivity and the actual sensitivity;

wherein the new gain is determined according to the following algorithm:

$$G_{NEW}=G_0+(S_T-S_M),$$

wherein $G_{NEW}$ is the new gain, $G_0$ is the default gain, $S_T$ is the target sensitivity, and $S_M$ is the actual sensitivity.

11. The method as claimed in claim 10, wherein the microphone module is an electret condenser microphone (ECM).

12. The method as claimed in claim 10, wherein the microphone module comprises a microphone and an integrated circuit attached to the microphone, and the integrated circuit comprises:

a buffer, buffering a first signal generated by the microphone, and outputting the first signal as a second signal;

a gain stage, amplifying the second signal according to the adjustable gain to obtain a third signal;

an analog-to-digital converter (ADC), converting the third signal from analog to digital to obtain the output signal; and a memory module, storing the adjustable gain, and outputting the adjustable gain to the gain stage for controlling amplification of the gain stage.

13. A microphone gain calibration system, comprising:

a speaker, playing a monotone sound;

a microphone module, comprising a microphone converting the monotone sound into a first signal, and an integrated circuit amplifying the first signal according to a default gain to generate an output signal; and a computer, determining a target sensitivity, measuring an actual sensitivity of the microphone module according to the output signal, determining the new gain according to the default gain and a difference between the target sensitivity and the actual sensitivity, and changing an adjustable gain of the integrated circuit from the default gain to the new gain;

wherein the computer determines the new gain according to the following algorithm:

$$G_{NEW}=G_0+(S_T-S_M),$$

wherein $G_{NEW}$ is the new gain, $G_0$ is the default gain, $S_T$ is the target sensitivity and $S_M$ is the actual sensitivity.

14. The microphone gain calibration system as claimed in claim 13, wherein the integrated circuit comprises:

a buffer, buffering the first signal generated by the microphone, and outputting the first signal as a second signal;

a gain stage, amplifying the second signal according to the adjustable gain to obtain a third signal;

an analog-to-digital converter (ADC), converting the third signal from analog to digital to obtain the output signal;

a memory module, storing the adjustable gain, and outputting the adjustable gain to the gain stage for controlling amplification of the gain stage; and a data interface, coupled to the computer, receiving a clock signal for operating the integrated circuit from the computer, outputting the output signal to the computer, and setting the adjustable gain stored in the memory module according to the computer.

15. The microphone gain calibration system as claimed in claim 14, wherein the gain stage comprises:

an operational amplifier, having a positive input terminal coupled to a voltage source and an output terminal generating the third signal;

a first adjustable resistor, coupled between an output terminal of the buffer and a negative input terminal of the operational amplifier, wherein the output terminal of the buffer generates the second signal;

a second adjustable resistor, coupled between the negative input terminal and the output terminal of the operational amplifier; and a gain control circuit, adjusting resistance of the first adjustable resistor and the second adjustable resistor according to the adjustable gain.

16. The microphone gain calibration system as claimed in claim 14, wherein the memory module comprises:

an address buffer, storing a target address;

a memory cell array, storing the adjustable gain;

a write buffer, buffering the adjustable gain written to the target address of the memory cell array;

a read buffer, buffering the adjustable gain read from the target address of the memory cell array;

a control module, controlling the address buffer, the write buffer, and the read buffer to access the adjustable gain stored in the memory cell array.

* * * * *